US008859903B2

(12) United States Patent
Jorand et al.

(10) Patent No.: US 8,859,903 B2
(45) Date of Patent: Oct. 14, 2014

(54) SUBSTANTIALLY FLAT FIRE-RESISTANT SAFETY CABLE

(75) Inventors: Thierry Jorand, Marle (FR); Jean-Louis Pons, Saint Serotin (FR)

(73) Assignee: Prysmian Energie Cables et Systemes France, Sens (FR)

( * ) Notice: Subject to any disclaimer, the term of this patent is extended or adjusted under 35 U.S.C. 154(b) by 862 days.

(21) Appl. No.: 11/989,290

(22) PCT Filed: Jul. 29, 2005

(86) PCT No.: PCT/FR2005/001988
§ 371 (c)(1),
(2), (4) Date: Jul. 11, 2008

(87) PCT Pub. No.: WO2007/012703
PCT Pub. Date: Feb. 1, 2007

(65) Prior Publication Data
US 2009/0133897 A1 May 28, 2009

(51) Int. Cl.
*H01B 7/08* (2006.01)
*H01B 3/30* (2006.01)
*H01B 7/295* (2006.01)

(52) U.S. Cl.
CPC . *H01B 7/295* (2013.01); *H01B 3/30* (2013.01)
USPC ..... 174/117 F; 174/121 A

(58) Field of Classification Search
USPC ..... 174/113 R, 117 F, 121 A
See application file for complete search history.

(56) References Cited

U.S. PATENT DOCUMENTS

| | | | | | |
|---|---|---|---|---|---|
| 2,471,752 | A | * | 5/1949 | Ingmanson | 156/52 |
| 3,013,109 | A | * | 12/1961 | Gorman et al. | 174/113 R |
| 3,219,752 | A | * | 11/1965 | Harris | 174/117 R |
| 4,468,089 | A | | 8/1984 | Brorein | |
| 4,549,041 | A | * | 10/1985 | Shingo et al. | 174/113 R |
| 5,173,960 | A | | 12/1992 | Dickinson | |
| 6,017,987 | A | * | 1/2000 | Okisaki et al. | 524/408 |

(Continued)

FOREIGN PATENT DOCUMENTS

| | | |
|---|---|---|
| CA | 2 520 458 A1 | 10/2004 |
| EP | 0249252 | 12/1987 |

(Continued)

OTHER PUBLICATIONS

Canadian Office Action dated Aug. 19, 2013, for corresponding Canadian Application No. 2,617,098.

*Primary Examiner* — Chau N Nguyen
(74) *Attorney, Agent, or Firm* — Harness, Dickey & Pierce, PLC

(57) ABSTRACT

A fire-resistant safety cable may include at least two electrical conductors, an insulating layer around each of the at least two electrical conductors in order to obtain at least two insulated elements, and an outer jacket surrounding the at least two insulated elements. The cable may have, in cross-section, an external outline including at least two substantially plane faces that are substantially parallel to each other. The insulating layer may be formed from at least one polymeric material being adapted to be converted, at least on a surface of the at least one polymeric material, into a ceramic state at high temperatures in a fire. The at least two insulated elements may be mutually adjacent, side by side, with axes of the at least two insulated elements lying in a plane between the at least two substantially plane faces.

16 Claims, 2 Drawing Sheets

(56) References Cited

U.S. PATENT DOCUMENTS

| | | | | |
|---|---|---|---|---|
| 6,222,129 | B1 * | 4/2001 | Siekierka et al. | 174/113 R |
| 6,995,198 | B2 * | 2/2006 | Toshimitsu et al. | 523/204 |
| 7,358,436 | B2 * | 4/2008 | Dellagala et al. | 174/27 |
| 7,829,792 | B2 * | 11/2010 | Pons et al. | 174/110 R |
| 2004/0050578 | A1 | 3/2004 | Hudson | |
| 2004/0106709 | A1 | 6/2004 | Toshimitsu et al. | |

FOREIGN PATENT DOCUMENTS

| | | | |
|---|---|---|---|
| EP | 0942439 | | 9/1999 |
| EP | 1000981 | | 5/2000 |
| JP | 64-030106 | | 2/1989 |
| JP | 01-117204 | | 5/1989 |
| JP | 2002-367443 | A | 12/2002 |
| WO | WO 97/48108 | A1 | 12/1997 |

* cited by examiner

SUBSTANTIALLY FLAT FIRE-RESISTANT SAFETY CABLE

CROSS-REFERENCE TO RELATED APPLICATIONS

This application is a national stage entry from International Application No. PCT/FR2005/001988, filed on Jul. 29, 2005, in the Receiving Office of the National Institute of Industrial Property (France), the entire contents of which are incorporated herein by reference.

BACKGROUND

1. Field

The present invention relates to a fire-resistant safety cable, More particularly, the present invention relates to a substantially flat fire-resistant cable, which comprises at least two electrical conductors that are adjacent to one another.

2. Description of Related Art

Safety cables are especially power-transporting or data-transmitting cables, such as for control or signaling applications.

Fire-resistant safety cables must, in a fire, maintain an electrical function. Preferably, said cables must also not propagate the fire. Said safety cables are used for example for lighting emergency exits and in elevator installations.

Fire-resistant cables must meet the criteria, for example set by the French standard NF C 32-070. According to this standard, the cable is placed horizontally in a tube furnace, the temperature of which is raised to 920° C. and held there for 50 minutes. The cable must not undergo a short circuit during this temperature rise and during 15 minutes at 920° C. Throughout this time, to simulate the falling of objects in a fire, the cable is periodically subjected to a shock by a metal bar in order to shake the cable.

Cables passing the test defined by NF C 32-070, paragraph 2-3 belong to the CR1 category.

Criteria similar to those defined in French standard NF C 32-070 are also defined by international standards, such as IEC 60331, or European standards, such as EN 50200.

Documents JP 01-117204 and JP 01-030106 disclose two fire-resistant flat cables, said cables comprising several conductors surrounded by an insulator and by a polyethylene outer jacket, the insulating layer of each electrical conductor consisting of mica tapes.

The Applicant has noticed that a fire-resistant cable provided with an insulating layer consisting of mica tapes has several drawbacks. In particular, such a cable may have a gap (or space exposing the conductor) in the mica tape wrapping, thereby causing a fault in the protection of the conductors, leading to a short circuit.

Fire-resistant cables having an approximately round cross section are also known.

For example, document EP 942 439 discloses a fire-resistant halogen-free round safety cable, comprising at least one conductor, an insulator around each conductor, and an outer jacket, empty spaces being provided between said jacket and said insulator of each electrical conductor.

The insulator of each conductor is made of a composition formed from a polymeric material containing at least one ceramic-forming filler capable of being converted, at least on the surface, to the ceramic state at high temperatures corresponding to fire conditions.

The outer jacket is made of a polyolefin composition containing at least one metal hydroxide filler.

The Applicant has noticed that a fire-resistant cable having a round cross section has several drawbacks. For example, in a fire, a fire-resistant cable having a round section has a high risk of contaminating the insulating layer with the ash resulting from the combustion of the outer jacket. The Applicant has noted that this is especially due to the reciprocal arrangement of the insulated elements. This is because, in the case of a cable comprising more than two insulated elements, at least one insulating element is superposed on the others so as to provide the cable with a round cross section. An insulated element generally comprises an electrical conductor and an insulating layer surrounding said conductor.

In the case of a fire-resistant cable having a round cross section, the outer jacket is generally converted, through the action of a fire, to ash, which may impede the conversion of the polymeric material of the insulator to a ceramic, causing the appearance of cracks in the insulator of the conductor.

Furthermore, the superposition of the insulated elements may cause the size of the cracks to increase appreciably, resulting in collapse of the insulating layer(s) contaminated by said ash. These drawbacks result in a reduction in the insulating protection provided by the insulating layer(s) of the cable and to an increase in the risk of short-circuiting the conductors. These risks relate in particular to the superposed insulated elements.

Furthermore, this ash may cause the volume and surface conductivity of the insulation to increase, which would impair the proper operation of the cable.

In addition, the insulated electrical conductors (or insulated elements) used in round fire-resistant safety cables are generally twisted.

The twisting of the insulated elements leads to the existence of multiple contact zones between said insulated elements, especially when based on three elements, incurring risks of short-circuiting, for example when the insulator has defects in its structure, such as cracks that may be created during conversion of the insulator on the conductors to ceramic at high temperature.

Moreover, in a fire, objects such as a beam or elements of a building structure may fall and strike the cable, and thus damage the latter or impair the mechanical integrity of the insulator converted to ceramic, or in the process of being converted to ceramic, of each element. The fall of such an object may cause, in the case of twisted elements, an insulated element to be compressed between said object and another element of the same cable, damaging the insulator converted to ceramic or in the process of being converted to ceramic, and thus short-circuiting the two conductors.

Furthermore, the twisting of the cable elements generally results in the formation of mechanical stresses that remain within the cable and are released during a fire, which may damage the insulation material of the cable during its conversion to a ceramic layer.

There is therefore a need for a fire-resistant cable that allows the abovementioned drawbacks to be alleviated.

SUMMARY

According to the invention, the Applicant has found that a fire-resistant cable which is flat and the insulating layer of which consists of at least one polymeric material capable of being converted, at least on the surface, to the ceramic state at high temperatures in a fire makes it possible to overcome the abovementioned drawbacks. In particular, the Applicant has found that the flat fire-resistant cable according to the present invention makes it possible to alleviate the drawbacks of a cable of round cross section and those of a cable in which the insulating layer consists of mica tapes as barrier to the propagation of the fire.

The subject of the present invention is therefore a fire-resistant safety cable comprising:

at least two electrical conductors;

an insulating layer around each electrical conductor in order to obtain at least two insulated elements, the insulating layer being formed from at least one polymeric material capable of being converted, at least on the surface, into the ceramic state at high temperatures in a fire; and an outer jacket surrounding said insulating elements, said cable having, in cross section, an external outline comprising at least two substantially plane faces that are substantially parallel to each other, the insulated conductors being mutually adjacent, side by side, and their axes lying in one and the same plane between said at least two faces.

This cable is preferably a halogen-free non-fire-propagating cable. The term "halogen-free cable" is understood to mean a cable in which the constituents are substantially non-halogenated. Even more preferably, the constituents contain no halogen compound.

As mentioned above, the fire-resistant cable according to the present invention is substantially flat, that is to say it has at least two substantially plane faces that are substantially parallel to each other, the insulated elements being mutually adjacent and their axes lying in one and the same plane, which is between said at least two faces.

Preferably, the cable jacket has, in cross section, an external profile (or external outline) that follows substantially the shape of the envelope of the insulated elements that are located inside the cable jacket, their axes lying in one and the same plane. In more detail, the cable jacket preferably has a thickness that is approximately constant over the external surface of the insulated elements and may be reduced to a minimum value sufficient to give the cable the typical protection of a cable jacket.

In this way, the cable of the present invention leads to a reduction in the amount of jacket material used to produce the cable, especially for two-conductor cables. This results, on the one hand, in a reduction in the manufacturing cost of the cable and, on the other hand, in a reduction in the incandescence time, in the thermal energy released from a fire and the amount of ash resulting from the combustion of the jacket. These aspects are particularly advantageous since the risk of cracks appearing, which may be caused by the ash during conversion of the insulator to ceramic at high temperatures in a fire, may be considerably reduced.

Moreover, in the case of three-conductor cables, the external surface of the jacket has a larger area in the present invention, thereby allowing better heat exchange and better and more rapid combustion of the jacket, which will then cause less disturbance to the conversion of the insulator to ceramic in a fire.

The particular arrangement of the insulated elements as defined in the invention also makes it possible to increase the electrical strength of the conductors, while reducing any short-circuiting of the conductors.

This is because, in a fire, this particular arrangement of the insulated elements, which allows the number of regions of contact between the insulated elements to be limited, in particular for a cable based on three insulated elements, also results in the short-circuiting risks being limited during conversion of the insulator to ceramic or when the insulator is already in ceramic form.

In addition, the fact of no longer having to twist the insulated elements makes it possible to eliminate the residual mechanical stresses on each element, due to this twisting, which could be released during a fire and impair the integrity of the cable and most particularly that of the insulator during conversion to ceramic or when the insulator is already in ceramic is form.

This aligned arrangement of insulated elements in one and the same plane (i.e. the arrangement consisting in having the insulated elements mutually adjacent, side by side) makes manufacture of the cables easier, by eliminating the twisting step, but also allows the cables to be stacked, during their installation, in more compact form than that obtained with round cables.

Advantageously, the cable according to the present invention has, in cross section, an approximately rectangular external outline and, more particularly, two substantially plane faces that are substantially-parallel to the plane containing the axes of the conductors and two substantially rounded lateral portions that are joined to said two faces.

Preferably, as mentioned above, the substantially flat fire-resistant cable of the present invention includes a cable jacket having an external profile that substantially matches the shape of the envelope of the insulated elements. For example, for a two-conductor cable, the cable thus has in cross section a "figure of 8" shape.

The material of the outer jacket preferably comprises an ethylene/vinyl acetate copolymer (or EVA), a polysiloxane, a polyolefin such as a polyethylene, a polyvinyl chloride (or PVC) or a blend thereof. The material of the outer jacket may furthermore include mineral fillers capable of being converted to residual ash under the effect of high temperatures in a fire, such as chalk, kaolin, metal oxides such as hydrated alumina, or metal hydroxides such as magnesium hydroxide, metal oxides or hydroxides possibly serving as fire-retardant fillers.

The material of the outer jacket may optionally be expanded so as to improve in particular the impact resistance of the cable, which jacket may be subjected to an impact when an object falls onto it in a fire.

The outer jacket may take the form of a single layer or several layers of polymeric material(s), for example 2, 3 or 4 layers. For example, it is possible to give the cable an appropriate jacket layer for providing a particular technical function, for example for absorbing accidental impacts on the cable or for improving the fluid resistance of the cable.

In the cables of the invention, the insulating layer is formed in particular from at least one polymeric material capable of being converted, at least on the surface, to the ceramic state at high temperatures in a fire, especially within the range from 400° C. to 1200° C. This conversion to the ceramic state of the polymeric material of the insulating layer makes it possible for the physical integrity of the cable and its electrical operation to be maintained under fire conditions.

The polymeric material of the insulating layer is preferably a polysiloxane, such as a crosslinked silicone rubber. The insulating layer may furthermore include, preferably, a filler that forms a ceramic under the effect of high temperatures in a fire, such as silica or metal oxides.

According to another embodiment of the present invention, the polymeric material of the insulating layer may be expanded. This expansion makes it possible in particular to improve the impact strength of the insulated conductor, which conductor may be subjected to an impact in a fire as a result of an object such as a beam falling onto it.

The insulating layer may take the form of a single layer or several layers of polymeric material(s), such as 2 or 3 layers or more.

A bulking material may furthermore be included between the insulating layer of each conductor and the outer jacket.

The bulking material is preferably chosen from an ethylene/vinyl acetate copolymer (or EVA), a polysiloxane, a polyolefin such as a polyethylene, a polyvinyl chloride (or PVC) or a blend thereof. The bulking material may furthermore include mineral fillers capable of being converted to residual ash under the effect of high temperatures in a fire, such as chalk, kaolin, metal oxides such as hydrated alumina, or metal hydroxides such as magnesium hydroxide, it being possible for the metal oxides or hydroxides to serve as fire-retardant fillers.

According to one particular embodiment of the invention, the cable comprises at least two insulated elements, each insulated element comprising an insulating layer surrounding an electrical conductor, said elements being arranged side by side and separated from each other by a space.

The space is located in a transverse position relative to the axes of the cable conductors. Preferably, said space is from about 0.1 mm to about 20 mm, or better still from about 1 mm to about 3 mm.

This axial space is preferably filled with the material of the jacket as defined above, or with a polymeric material capable of being converted, at least on the surface, to the ceramic state at high temperatures in a fire, which is identical to or different from that used in the insulating layer, or else with a bulking material.

In the case in which said space is filled with the material of the cable jacket, the cable jacket is introduced, for example by extrusion, in such a way that it completely surrounds the insulated elements. This embodiment makes it possible to further reduce the abovementioned short-circuiting risks.

Another preferred embodiment consists in arranging the insulated elements beside one another and being substantially in contact with one another so that no space is present between two adjacent insulated elements.

BRIEF DESCRIPTION OF THE DRAWINGS

The invention and the advantages that it affords will be better understood thanks to the exemplary embodiments given below by way of nonlimiting indication, these being illustrated by the appended drawings in which.

DETAILED DESCRIPTION OF EXAMPLE EMBODIMENTS

Figure 1:
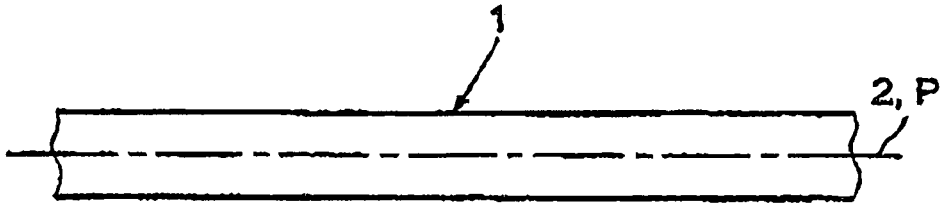
FIG. 1 is a side view of a cable according to the invention.

FIG. 1 shows schematically part of a cable 1 having an axis of symmetry 2.

Figure 2:
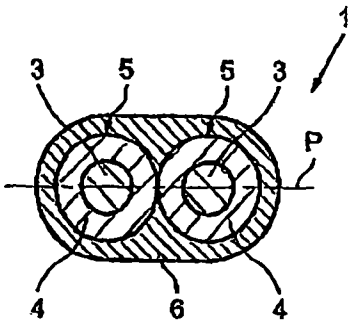
FIG. 2 shows a cross-sectional view of a cable having two electrical conductors according to a first embodiment.

The cable 1 according to a first embodiment, shown in FIG. 2, comprises two electrical conductors 3, two insulators 4—each of the insulators 4 lying around each conductor 3 and thus forming two insulated conductors (or elements) 5—and an outer jacket 6.

The two insulated conductors 5 are arranged so as to be parallel to each other and side by side in the longitudinal mid-plane P of the cable 1. They are in contact with each other, which means that there is no space present between the adjacent elements.

The outer jacket 6 is deposited on the insulated elements 5 and surrounds the insulated elements 5 so as to define at least two faces that are substantially plane and parallel to each other and to the longitudinal mid-plane P.

In cross-section, the cable has an approximately rectangular shape and in particular an outline having two plane faces parallel to the plane P that contains the axes of the two conductors 3 and two rounded lateral portions.

The material of the insulator 4 is preferably a polysiloxane which includes in particular a silica-type reinforcing filler. The insulator 4 preferably comprises a single polysiloxane layer.

The outer jacket 6 preferably consists of an EVA, optionally containing fillers such as metal oxides or hydroxides.

According to another embodiment (not shown) similar to that shown in FIG. 2 apart from the shape of the outer jacket 6 in cross section, the outer jacket 6 has an external profile that substantially matches the shape of the envelope of the insulated elements 5 so that the cable is in cross section a "figure of 8" shape.

Figure 3:
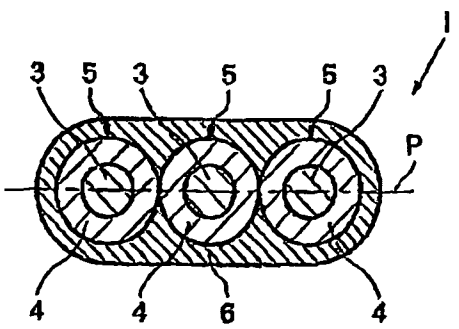
FIG. 3 shows a cross-sectional view of a cable having three electrical conductors according to a second embodiment.

The cable of FIG. 3 differs from that of FIG. 2 in that an additional insulated element 5 is introduced into the outer jacket 6, the axis of this additional insulated element 5 lying in the longitudinal mid-plane P of the cable 1.

Figure 4:
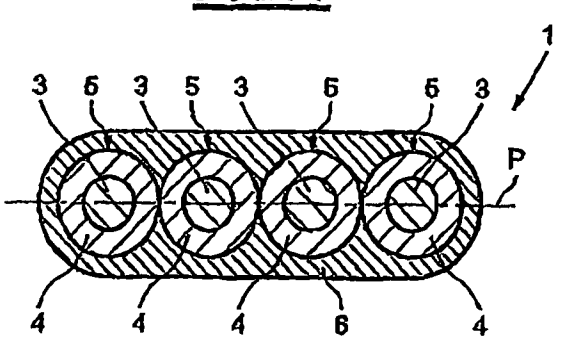
FIG. 4 shows a cross-sectional view of a cable having four electrical conductors according to a third embodiment.

The cable of FIG. 4 differs from that of FIG. 3 in that an additional insulated element 5 is introduced into the outer jacket 6, the axis of this additional insulated conductor 5 lying in the longitudinal mid-plane P of the cable 1.

Figure 5:
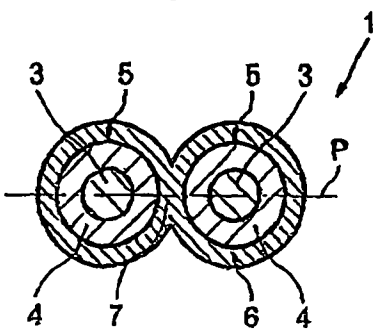
FIG. 5 shows a cross-sectional view of a cable having two electrical conductors according to a fourth embodiment.

The cable of FIG. 5 differs from that of FIG. 2 in that a space 7 separates the two insulated elements 5 and in that the outline of the outer jacket follows substantially the envelope of the insulating layers 4.

Figure 6:
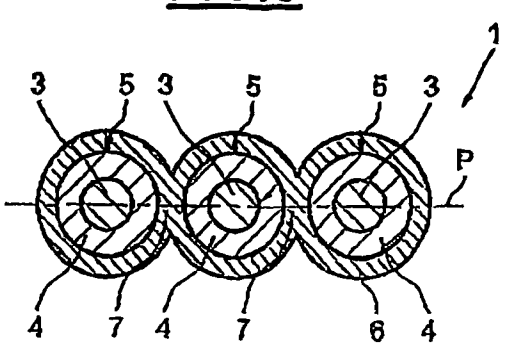
FIG. 6 shows a cross-sectional view of a cable having three conductors according to a fifth embodiment.

The cable of FIG. 6 differs from that of FIG. 5 in that three insulated elements 5 are shown.

Figure 7:
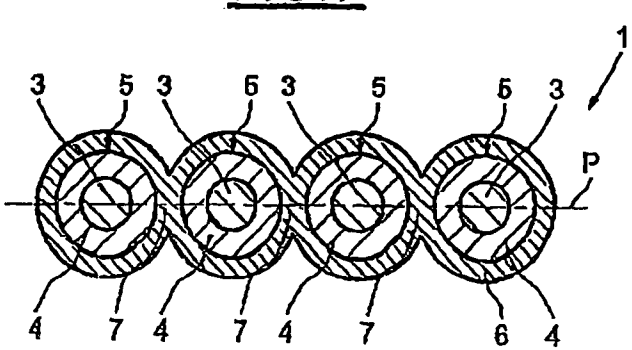
FIG. 7 shows a cross-sectional view of a cable having four conductors according to a sixth embodiment.

The cable of FIG. 7 differs from that of FIG. 5 in that four insulated elements 5 are shown.

The spaces 7 in FIGS. 5, 6 and 7 are preferably filled with the material of the jacket, such as an EVA.

These spaces 7 preferably measure from 0.1 mm to 20 mm, better still from 1 mm to 3 mm.

EXAMPLES

Example 1

Two cables A and B were tested according to French standard NF C 32-070.

Cable A was a substantially flat fire-resistant cable according to the invention. Cable B (comparative cable) was a fire-resistant cable identical to cable A except that cable B was round.

Two different compositions of cables A and B were tested: $2\times1.5\ mm^2$ (composition 1) and $3\times1.5\ mm^2$ (composition 2).

According to the French standard NF C 32-070, a fire-resistant cable must withstand a voltage of about 500 V during the rise in temperature up to 920° C. over 50 minutes, then at a constant temperature of about 920° C. for about 15 minutes.

All the cables tested met this minimum value required by the standard.

Next, the cables were tested by progressively increasing the voltage until a short circuit occurred.

The results of the latter tests—which are given in Tables 1 and 2—show that the flat cable of the present invention is capable of withstanding higher voltages than those withstood by the comparative round cable.

This is because the data of the tables show that cables A according to the invention withstand higher voltages than those withstood by cables B, or else that they withstand the same voltage but for a longer period of time than that of cables B.

TABLE 1

| | CABLE A (Invention) | | | |
|---|---|---|---|---|
| | Composition 1 | | Composition 2 | |
| 1st series | 65' at 500 V | OK | 65' at 500 V | OK |
| | 5' at 600 V | OK | 5' at 600 V | OK |
| | 5' at 700 V | OK | 5' at 700 V | OK |
| | 5' at 800 V | OK | 2" at 800 V | |
| | 4' 30" at 900 V | | | |
| 2nd series | 65' at 500 V | OK | 65' at 500 V | OK |
| | 5' at 600 V | OK | 5' at 600 V | OK |
| | 5' at 700 V | OK | 5' at 700 V | OK |
| | 3' 40" at 800 V | | 5' at 800 V | OK |
| | | | 5' at 900 V | OK |
| | | | 1' 30" at 1000 V | |

TABLE 2

| | CABLE B (Comparative cable) | | | |
|---|---|---|---|---|
| | Composition 1 | | Composition 2 | |
| 1st series | 65' at 500 V | OK | 65' at 500 V | OK |
| | 10" at 600 V | | 5' at 600 V | OK |
| | | | 5' at 700 V | OK |
| | | | 0" at 800 V | |
| 2nd series | 65' at 500 V | OK | 65' at 500 V | OK |
| | 5' at 600 V | OK | 5' at 600 V | OK |
| | 2' 26" at 700 V | | 5' at 700 V | OK |
| | | | 5' at 800 V | OK |
| | | | 0" at 900 V | |

The invention claimed is:

1. A fire-resistant safety cable, comprising:

at least two electrical conductors;

an insulating layer around each of the at least two electrical conductors in order to obtain at least two separate insulated elements; and an outer jacket surrounding the at least two separate insulated elements;

the cable having, in cross-section, an external outline comprising at least two substantially plane faces that are substantially parallel to each other, wherein the outer jacket comprises a material comprising an ethylene/vinyl acetate copolymer, a polysiloxane, a polyolefin, a polyvinyl chloride, or a blend thereof, the material including mineral fillers capable of being converted to residual ash under an effect of high temperatures in a fire, wherein the insulating layer is formed from a polysiloxane material and a filler material comprising silica that forms, at least on a surface of the insulating layer, a ceramic state at the high temperatures in the fire, and wherein the at least two separate insulated elements are untwisted and arranged so as to be parallel to each other and substantially in contact with one another.

2. The cable of claim 1, wherein the external outline is approximately rectangular.

3. The cable of claim 1, wherein the external outline has two rounded lateral portions joined to the at least two substantially plane faces.

4. The cable of claim 1, wherein the material of the outer jacket is expanded.

5. The cable of claim 1, wherein the polysiloxane material is expanded.

6. The cable of claim 1, wherein the at least two separate insulated elements are mutually adjacent, side by side.

7. The cable of claim 1, wherein the at least two electrical conductors comprise three electrical conductors.

8. The cable of claim 1, wherein the at least two electrical conductors comprise four electrical conductors.

9. A fire-resistant safety cable, comprising:

at least two electrical conductors;

an insulating layer around each of the at least two electrical conductors in order to obtain at least two separate insulated elements; and an outer jacket surrounding the at least two separate insulated elements;

the cable having, in cross-section, an external outline comprising at least two substantially plane faces that are substantially parallel to each other, wherein the outer jacket comprises a material comprising an ethylene/vinyl acetate copolymer, a polysiloxane, a polyolefin, a polyvinyl chloride, or a blend thereof, the material including mineral fillers capable of being converted to residual ash under an effect of high temperatures in a fire, wherein the outer jacket has a thickness that is approximately constant over an external surface of the at least two separate insulated elements, wherein the insulating layer is formed from a polysiloxane material and a filler material comprising silica that forms, at least on a surface of the insulating layer, a ceramic state at the high temperatures in the fire, and wherein the at least two separate insulated elements are untwisted and arranged so as to be parallel to each other.

10. The cable of claim 9, wherein the external outline is approximately rectangular.

11. The cable of claim 9, wherein the external outline has two rounded lateral portions joined to the at least two substantially plane faces.

12. The cable of claim 9, wherein the material of the outer jacket is expanded.

13. The cable of claim 9, wherein the polysiloxane material is expanded.

14. The cable of claim 9, wherein the at least two separate insulated elements are side by side.

15. The cable of claim 9, wherein the at least two electrical conductors comprise three electrical conductors.

16. The cable of claim 9, wherein the at least two electrical conductors comprise four electrical conductors.

* * * * *